United States Patent [19]

Beeson et al.

[11] 4,133,450

[45] Jan. 9, 1979

[54] TABLE LIGHTER DEVICE

[75] Inventors: Thomas T. Beeson, Fairfield; Salvatore A. LaMonica, Derby, both of Conn.

[73] Assignee: Bic Pen Corporation, Milford, Conn.

[21] Appl. No.: 806,342

[22] Filed: Jun. 14, 1977

[51] Int. Cl.[2] ..... B65D 25/02; B65D 85/20

[52] U.S. Cl. ..... 220/411; 206/37; 248/311.1 R; 431/142

[58] Field of Search ..... 206/86, 85, 87, 88, 206/89, 38, 37; 248/311.1, 176, 346, 188.1; 220/17, 1 H, 1 M, 411; D27/39, 40, 41, 36; 431/146, 129, 142

[56] References Cited

U.S. PATENT DOCUMENTS

| | | | |
|---|---|---|---|
| D. 222,105 | 9/1971 | Encausse | D27/39 |
| 2,045,457 | 6/1936 | Gabritsch | 431/142 |
| 2,480,139 | 8/1949 | Keene | 431/146 |
| 2,679,740 | 6/1954 | Seletzky | 431/129 |
| 2,728,211 | 12/1955 | Mihan | 431/142 |
| 2,774,234 | 12/1956 | Blaisdell et al. | 431/142 |
| 3,283,894 | 11/1966 | Hafner et al. | 206/306 |
| 3,498,734 | 3/1970 | Retzler | 431/142 |

*Primary Examiner*—William T. Dixson, Jr.
*Attorney, Agent, or firm*—Pennie & Edmonds

[57] ABSTRACT

A table lighter device is disclosed which comprises a base member having pocket lighter supporting means for supporting and retaining a generally elongated pocket lighter in a releasably secure upstanding fashion. Such table lighter device embodies a weighted member positionable about the lighter supporting means adjacent the bottom thereof. A housing is positioned in upstanding relation with respect to the base member and has at the lower end portion thereof, means for facilitating securement thereof to the base member. The housing defines an upper end portion having an opening generally dimensioned and configured to receive the pocket lighter and generally vertically aligned with the pocket lighter supporting means and is dimensioned and configured to removably receive and snugly support the pocket lighter while operative elements of the pocket lighter are exposed at the upper end portion of the housing to form an operative table lighter.

17 Claims, 6 Drawing Figures

TABLE LIGHTER DEVICE

BACKGROUND OF THE INVENTION

1. Field of the Invention

This invention is directed broadly to table lighter devices. More specifically, it pertains to a novel, improved, stable and simplified table lighter housing receptacle which may insertably accommodate a standard pocket lighter without the latter falling or rattling, as well as being adapted to provide a comfortable and hefty feel for a user's hand.

2. Description of the Prior Art

Heretofore, it has been conventional practice to retain a standard pocket lighter, such as of the butane type, in a receptacle to function as a table lighter. A wide variety of constructions presently exist for pocket lighter housings. In several, though, the lighter housings of the foregoing category suffer from several drawbacks. One of the more significant shortcomings results from the fact that such housings or receptacles are made of several distinct components and such constructional complexities often inhibit simple and easy assembly, as well as disassembly, if required for any reason. By virtue of such relatively complicated construction, the housings are relatively more expensive to manufacture. Thus, it will be appreciated that the resultant savings provide substantial economical advantages.

Furthermore, the prior art suffers from the drawback that it does not provide table lighter housings which are capable of providing a user with a comfortable and hefty feel while at the same time preventing conventional pocket lighters of somewhat varying dimensions from rattling and falling out during ordinary and customary use.

The present invention, however, overcomes the preceding enumerated drawbacks generally associated with known table lighter housings or receptacles and table lighters by providing a table lighter device capable of receiving therein a conventional pocket lighter, and which device is simple and economical in construction, easy to assemble and disassemble, and snugly and resiliently supports and retains a pocket lighter so as to prevent rattling and falling out of the latter. The present invention is fabricated from flame retardant material in a manner to provide a hefty and comfortable feel to a user's hand.

SUMMARY OF THE INVENTION

Broadly, in accordance with the principles of the present invention, there is disclosed a table lighter device which comprises a base member, means to support a generally elongated pocket lighter upstanding from said base member, a peripheral weighted member positioned about said lighter supporting means, a housing upstanding from said base member and having means at the lower end portion thereof to secure said housing to said base member, said housing defining at the upper end portion an opening generally configured to receive the pocket lighter and aligned generally vertically with said pocket lighter supporting means, said housing being dimensioned and configured to removably receive and support the pocket lighter within said opening at the upper end portion thereof, while the lower end portion of the pocket lighter is supported by said base member support means and operative elements of the pocket lighter are exposed at the upper end portion of the housing to form an operative table lighter.

In a preferred embodiment, the table lighter device is defined by a continuously smooth, generally elliptical contoured unitary shell made of a synthetic polycarbonate resinous flame retardant material which provides an easily grippable, glossy, aesthetic surface. Such housing has a generally peripheral groove which receives in snapped engagement, a peripheral ridge extending about the base member so as to complete the assembly of components. The pocket lighter supporting means preferably comprises a plurality of upstanding flexible lighter retaining fingers adapted to snugly and resiliently support and retain a pocket lighter therebetween. The weighted means is generally peripherally positionable about the retaining lighter supporting fingers and is secured between the housing and the retaining fingers.

BRIEF DESCRIPTION OF THE DRAWINGS

The above and other objects, features, and advantages of the present invention will become readily apparent upon a reading of a detailed description of a preferred embodiment when viewed in conjunction with the drawings.

DETAILED DESCRIPTION OF THE PREFERRED EMBODIMENT

Figure 1:
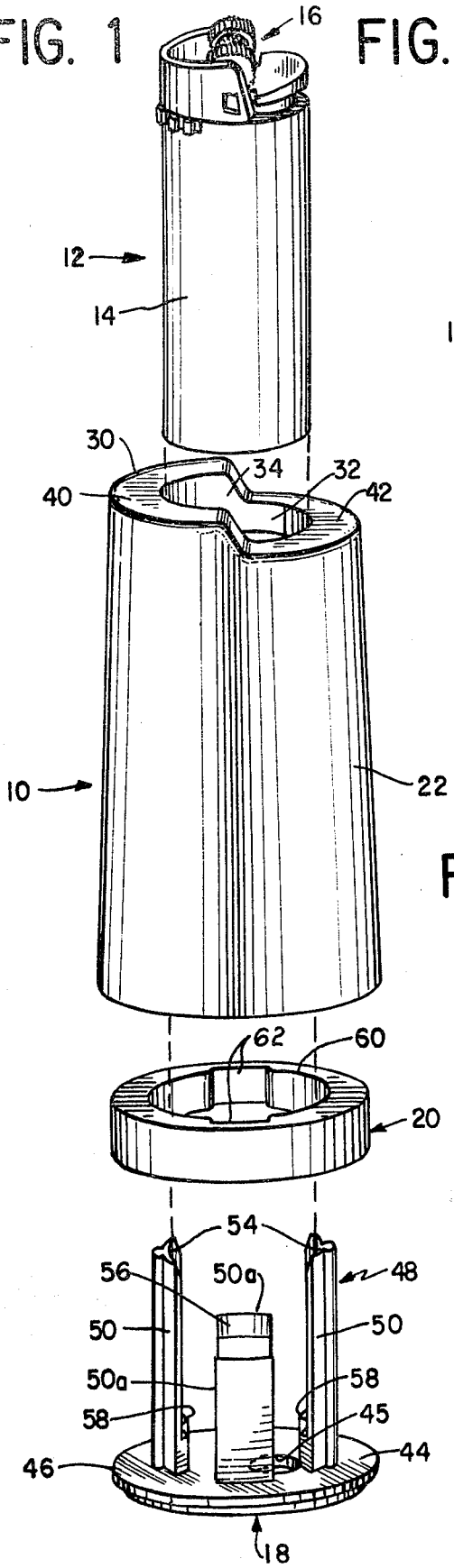
FIG. 1 is a perspective view of a table lighter arrangement illustrating details of the components forming the present invention.
Figure 2:
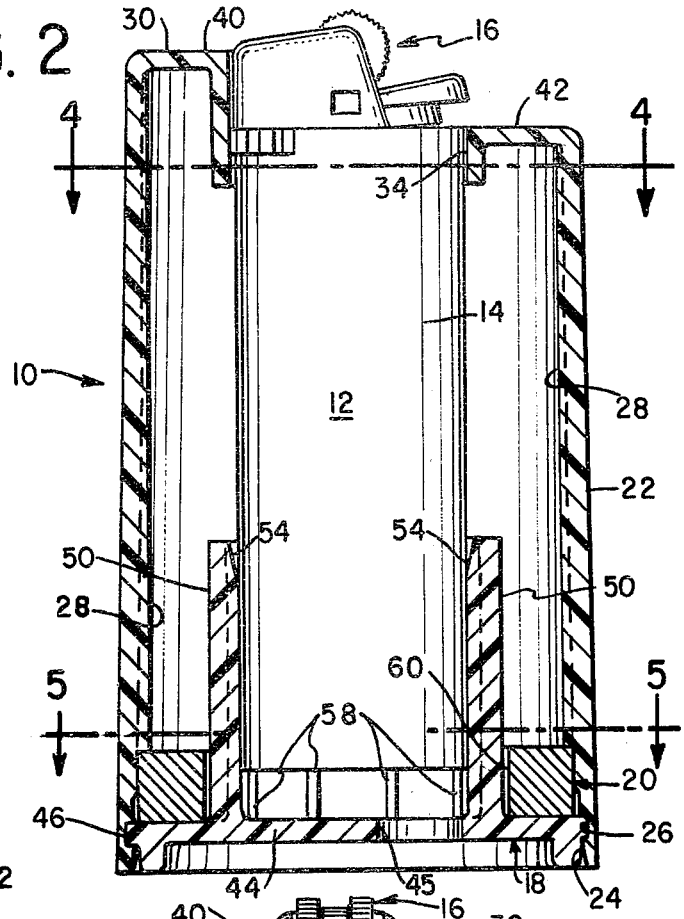
FIG. 2 is a cross-sectional view of the assembled table lighter device of the present invention having a pocket lighter in position so as to illustrate the cooperation between the components depicted in FIG. 1.

Referring now to the drawings and, in particular, to FIGS. 1 and 2, there is depicted a novel and improved table lighter housing constructed in accordance with the principles of this invention and being designated by reference numeral 10. In addition, a conventional type of butane pocket lighter 12 or the like is illustrated as being insertably retained in the housing to define an attractive table lighter. Such pocket lighter 12 is, of course, usable for the customary purposes of lighting cigars, cigarettes, pipes, and the like. The pocket lighter 12 includes a generally elongated outer case or housing member 14 having a generally elliptical cross-section. Attached to the top of the housing 14 are known operative lighter components with which an operator effectuates operation of the lighter and being designated generally by reference numeral 16.

As shown, the novel and improved table lighter device 10 of the present invention includes base member 18, weighted member 20, and housing 22. The housing 22 includes a bottom open end portion 24 and is constructed of a unitary and generally elliptical shell configuration which is particularly adapted for easy gripping by hand. Additionally, the exterior surface has a continuously smooth outer surface which promotes an aesthetic appearance and comfortable feel. Situated adjacent the bottom end portion 24 and inwardly with respect to the housing 22 is at least one generally peripheral groove 26 which facilitates, in a manner to be described, a snap-fit type of securing action between the housing and base member 18.

As perhaps best viewed in FIG. 2, housing 22 is formed with a plurality of generally elongated and circumferentially spaced tapered retaining ribs 28 which longitudinally extend along the major axis of the housing. The bottom ends of ribs 28 are adapted to snugly cooperate with the top of weighted member 20, whenever all of the components forming the novel and improved lighter device are assembled. As a consequence thereof, the weighted member 20 will be prevented from uncontrolled slidable movement and will be secured in a generally horizontal position in the lowermost position illustrated in FIG. 2. As a consequence thereof, the lighter device 10 will have a low center of gravity. This facilitates stability of the lighter housing 10 and such housing will have less of a tendency to be knocked over. The longitudinal ribs also function to enhance the rigidity of the housing 22 by tending to protect against crushing.

Although retaining ribs 28 have been described in the preferred embodiment, the invention contemplates that other types of retaining structure for cooperating with weighted means 20 may be employed to retain the latter in the desired position. For instance, the invention envisions crushable ribs.

Figure 3:
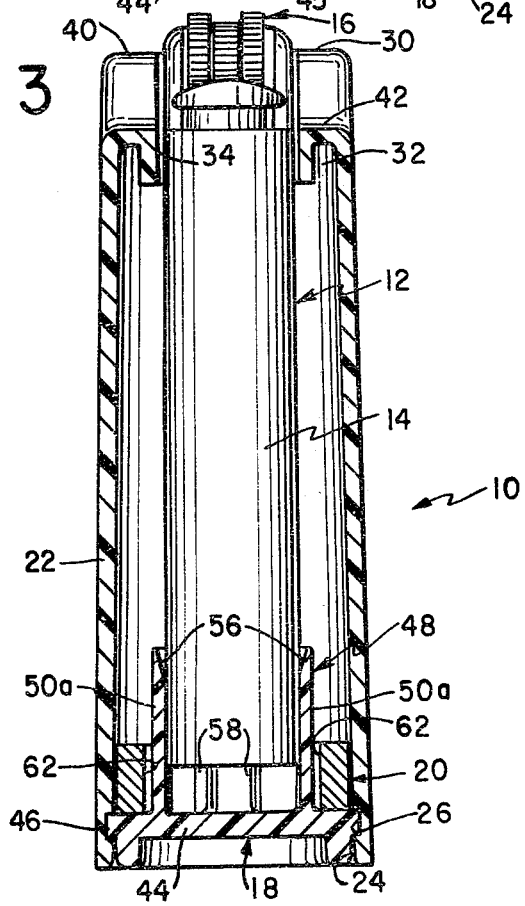
FIG. 3 represents a cross-sectional end view of the assembled components of FIG. 2.
Figure 4:
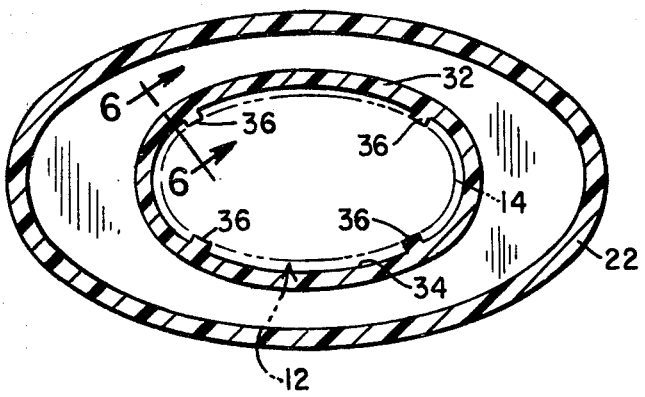
FIG. 4 is a cross-sectional view taken along section lines 4—4 of FIG. 3 illustrating other details of the novel and improved invention.

With continued reference to FIGS. 2 to 4, it is noted that housing 22 also incorporates an upper end wall 30 having a depending generally peripheral sidewall 32 generally centrally formed therein. Such sidewall is dimensioned and configured to define an open end 34. Upper end opening 34 is configured and dimensioned so as to generally closely conform to the configuration of the pocket lighter housing 14. The opening 34, in this particular embodiment, has a generally elliptical shape to receive the well-known BIC® brand butane pocket lighter as shown in the drawings. Moreover, sidewall 32 facilitates guidance of pocket lighter 12 into housing as well as enhances stability by virtue of its generally closely conforming configuration.

Figure 6:
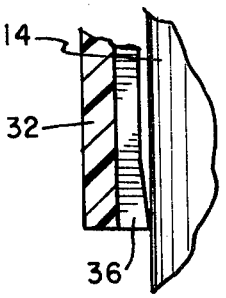
FIG. 6 represents a cross-sectional view taken along section lines 6—6 of FIG. 4 illustrating a pocket lighter retention feature.

Peripheral sidewall 32 may also be formed with a multiplicity of discrete generally tapered, flexible and resilient projection tabs 36. These projection tabs 36 may extend radially inwardly from the sidewall, such as shown in FIGS. 4 and 6, to snugly contact the casing wall 14 of the pocket lighter 12. Since tapered projection tabs 36 are located adjacent the bottom of peripheral wall 32 and given the fact that they are generally resilient, they will tend to bend outwardly and resiliently bias a standard pocket lighter 12 inserted in opening 34. Accordingly, the tabs 36 serve to prevent the tendency of the pocket lighter 12 from falling from housing 10. Moreover, such tabs 36, together with the peripheral sidewall 32 serve to prevent rattling of the pocket lighter 12 as well as assist in guidance of the latter. Moreover, such flexible tabs 36 can serve the purpose of accommodating pocket lighters having somewhat larger dimensions than those depicted in the drawings. Consequently, lighter housing 10 of the preferred embodiment is versatile insofar as it is permitted to accommodate pocket lighters of somewhat varying dimensions. Although this embodiment has disclosed a snugly conforming peripheral sidewall 32 with retaining tabs 36, the instant invention also contemplates within its scope other lighter support means such as a plurality of depending flexible guiding and retaining fingers.

As perhaps best shown in FIGS. 1 and 2, housing member 22 has its upper end wall 30 formed with raised and lowered portions 40 and 42, respectively. Raised portion 40 facilitates a user grasping the housing 22 with fingers, while the lower portion 42 facilitates an operator striking operative components 16 of pocket lighter 12.

Moreover, in this embodiment, housing 22 is preferably made of a generally resilient and flexible material which is flame retardant, as well as strong and durable in use as well as also provides a glossy, smooth finish. This material may be fabricated from, for example, a polycarbonate resin marketed by the General Electric Company of Pittsfield, Massachusetts under the registered trademark LEXAN 940. Other materials may be used provided, of course, that they have properties of sufficient strength, durability, flexibility, flame retardancy, and ability to provide an attractive finish.

Referring now to base member 18, it is seen to include a generally flat base member portion 44 having an opening 45 therethrough. Opening 45 is adapted to be in general communication with the interior of lighter housing 10. It permits a user to push an instrument therethrough so as to facilitate removal of the pocket lighter 12 from the housing 10. Base member 44 is formed with peripheral ridge 46 which is adapted to have a snap fit interengagement with peripheral groove 26 formed in the housing 22. By virtue of this particular snap-fit arrangement base member 18 and housing 22 are easily and advantageously secured to each other. Alternatively, of course, the snap fit facilitates a quick and easy separation of both base member 18 and housing 22. This invention envisions that other types of locking or latching arrangements may be provided for a securable arrangement between base means 18 and housing 22.

Base member 18 also includes upstanding pocket lighter supporting means 48. Upstanding supporting means 48, include first and second pairs of upstanding generally elongated flexible fingers 50 and **50*a*, respectively. As best viewed in FIG. 1 and taken in conjunction with FIGS. 2, 3 and 5, the upstanding fingers 50 and 50*a* are spacially arranged and appropriately formed so as to generally conform to a pocket lighter housing case 14 with an elliptical configuration. In the present embodiment, the fingers 50 and 50*a* are in general alignment with the opening 34 and peripheral wall 32 to enhance guidance and stability of the pocket lighter 12**.

Figure 5:
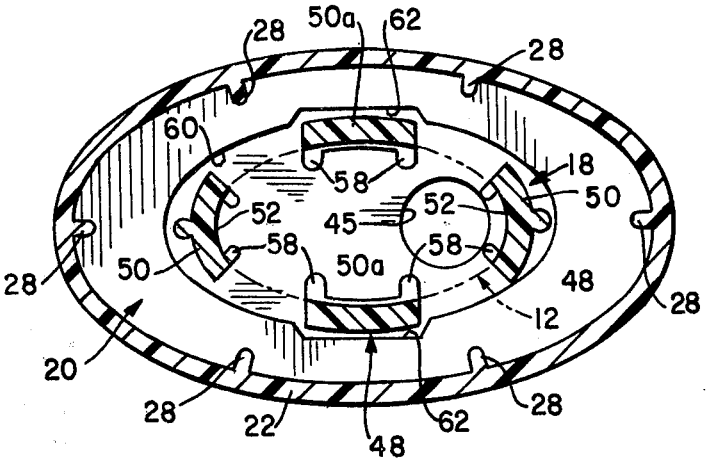
FIG. 5 is a cross-sectional view taken along section lines 5—5 in FIG. 2 illustrating other details of the novel and improved table lighter arrangement of the present invention.

The first pair of upstanding fingers 50 includes a generally curved or arcuate portion 52, as shown in FIGS. 1 and 5. Curved portions 52 are also formed with inclined beveled upper edges 54. The fingers 50 function to yieldably cooperate with the pocket lighter to facilitate a retaining and guiding function of the latter. Owing to the fact that the fingers 50 are flexible and snugly conform to the pocket lighter casing 14, they serve to retain the pocket lighter 12 in position. Likewise, upstanding fingers **50*a* also are generally arcuate in cross-section form and have beveled upper portions 56. Upstanding fingers 50*a* with beveled upper portions 56 together with the flexible nature of such upstanding fingers 50*a* similarly facilitates the latter snugly conforming to the pocket lighter 12** to thereby retain the same.

The present invention, however, does not limit the particular configuration and spacing arrangement of the fingers 50 and 50a insofar as it contemplates having the fingers being of varying dimensions, shapes, and arranged in any particular fashion, to yieldably and snugly grasp the pocket lighter 12 therebetween.

Upstanding rib portions 58 are formed integrally with each of the upstanding fingers 50 and 50a and are located adjacent the bottom thereof, such as depicted in FIGS. 1, 2, 3 and 5. As illustrated, ribs 58 serve to support the bottom of the pocket lighter 12 in a firm manner. Such ribs 58 are dimensioned to ensure that the operative components 16 of lighter 12 will, whenever the latter is in the inserted position, be exposed for normal operation thereof by a user.

Now, referring to the weighted member or means 20, the illustrated embodiment depicts it as a generally elliptically shaped member having mounting opening 60 which also has a generally elliptical shape. Opening 60 has a pair of diametrically opposed cut-outs 62. The opening 60 with cut-outs 62 are suitably formed to permit weighted means 20 being peripherally mounted about the upstanding fingers 50 and 50a. As above mentioned, the weight 20 assumes a horizontal position adjacent the bottom of such upstanding retaining and supporting fingers 50 and 50a. It is being kept in mind, of course, that the retaining ribs 28 tend to secure the weight 20 in the depicted position. Instead of weight 20 being retained by ribs 28 of the type mentioned, it may also cooperate with crushable ribs as to retain its position. Accordingly, this particular structural relation of components serves to advantageously enhance stability of the lighter housing 10 by reason of the latter having a low center of gravity. Moreover, the weight 20, owing to its weight, provides the lighter housing 10 with a comfortable, hefty feel. Weight 20 of this particular embodiment is fabricated from a suitable metal, but may be fabricated of any suitable flame retardant material.

After having explained the above organization of components, it is believed the assembly and use thereof is self-evident. To supplement the foregoing description, however, it will be recognized that whenever a typical butane pocket lighter 12, of the type shown and described, is inserted through upper end opening 34, it will be guided by resilient sidewalls 32 including resilient sidewalls 32 including resilient tabs 36. Moreover, owing to the resilient nature of such peripheral walls 32, tabs 36, and fingers 50 and 50a, and given their particular alignment, they will easily guide, accommodate, and generally frictionally hold pocket lighters 12 of the type disclosed in a stable position free from the latter rattling or falling out. Also, such tabs 36 and fingers 50 and 50a are also capable of snugly holding pocket lighters 12 having somewhat larger sizes than depicted in the drawing.

It will be appreciated that by reason of the foregoing construction, the present invention provides a novel and improved pocket lighter housing that can have releasably inserted therein a standard-type butane pocket lighter to form an aesthetic, comfortable and simple table lighter. Such table lighter housing 10 is constructed of a simple, three-piece arrangement which can be easily and simply manufactured as well as assembled and disassembled. Beyond the foregoing, pocket lighter housing 10 is stable and made of a resilient and flexible material which is flame retardant and producable with a glossy aesthetic outer surface.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims.

We claim:

1. A table lighter device which comprises in combination:

(A) a base member having a plurality of integral upstanding projections disposed to receive a generally elongated pocket lighter therebetween;

(B) a weighted ring member positioned on the base member about the periphery of the upstanding projections; and (C) an upstanding housing secured by a lower end portion to the base member, said housing having an opening at an upper end portion which is configurated to receive the pocket lighter, said opening being aligned generally vertically with the upstanding projections, said housing being dimensioned to removably receive the body portion of the pocket lighter therein while exposing operative elements of the pocket lighter sufficiently to permit lighting thereof.

2. The table lighter device of claim 1 wherein the upstanding projections are relatively flexible and disposed to snugly receive the pocket lighter.

3. The table lighter device of claim 1 wherein the base member has a peripheral ridge and wherein the upstanding housing has a peripheral groove disposed to secure the lower end portion with the base member.

4. The table lighter of claim 1 wherein upstanding rib portions are integrally disposed within the upstanding projections and adjacent the base member.

5. The table lighter of claim 1 wherein the weighted ring member is secured in position by elongated, circumferentially spaced tapered retaining ribs which longitudinally extend along the inner surface of the upstanding housing.

6. The table lighter device as set forth in claim 1 wherein said housing is fabricated of a flexible and flame retardant material.

7. The table lighter device as set forth in claim 6 wherein said flexible material is a polycarbonate resin.

8. The table lighter device as set forth in claim 7 wherein said flexible material is LEXAN brand polycarbonate resin.

9. The table lighter device as set forth in claim 6 wherein said peripheral weighted member is a ring-like member constructed of a flame retardant material and configured to be positioned about said upstanding lighter support members.

10. The lighter device as set forth in claim 9 wherein said opening at the upper end portion of said lighter housing is defined by at least one generally downwardly extending peripheral wall portion.

11. The table lighter device as set forth in claim 10 wherein said peripheral wall has connected thereto, a plurality of peripherally spaced and generally radially inwardly directed flexible tapered tab members dimensioned and positioned to engage upper surface portions of the pocket lighter for snug reception therein.

12. The table lighter device as set forth in claim 6 wherein said means at the lower end portion of said housing to secure said housing to said base member comprises at least one generally peripheral groove configured for snapping reception of said base means.

13. The table lighter device as set forth in claim 12 wherein said base member includes a peripheral ridge dimensioned and positioned to cooperate with said groove in said housing at the lower end portion thereof.

14. The table lighter device as set forth in claim 13 wherein said housing comprises a generally elliptically configured shell having a continuously smooth outer surface which facilitates an ease of grip and comfortable hand.

15. The table lighter device as set forth in claim 13 wherein said lighter support members upstanding from said base member comprise rib-like members upstanding therefrom.

16. A table lighter device set forth in claim 15 wherein said housing is formed with retaining means for securing said weighted means in the assembled position.

17. A table lighter device as set forth in claim 16 wherein said retaining means is comprised of a plurality of longitudinally extending retaining ribs which contact a top surface of said weighted means.

* * * * *